United States Patent [19]

Kanezawa

[11] Patent Number: 4,876,422

[45] Date of Patent: Oct. 24, 1989

[54] WATERPROOF SWITCH

[75] Inventor: Nobuyoshi Kanezawa, Kaashiwa, Japan

[73] Assignee: Uchiya Termostat Co., Misato, Japan

[21] Appl. No.: 186,133

[22] Filed: Apr. 26, 1988

[30] Foreign Application Priority Data

Jan. 25, 1988 [JP] Japan ..... 63-7915[U]

[51] Int. Cl.[4] ..... H01H 9/04

[52] U.S. Cl. ..... 200/302.1; 200/547

[58] Field of Search ..... 200/302.3, 302.2, 302.1, 200/324, 325, 327, 303, 304, 547, 548

[56] References Cited

U.S. PATENT DOCUMENTS

| | | | |
|---|---|---|---|
| 3,215,807 | 11/1965 | Spitler | 200/302.1 |
| 3,898,397 | 8/1975 | Devore et al. | 200/302.3 |
| 4,066,870 | 1/1978 | Colten | 200/302.1 |
| 4,342,894 | 8/1982 | Scott et al. | 200/302.1 |
| 4,427,006 | 1/1984 | Nottke | 200/302.2 |
| 4,441,000 | 4/1984 | Suwa | 200/548 |
| 4,742,199 | 5/1988 | Andis et al. | 200/302.1 |

FOREIGN PATENT DOCUMENTS

| | | |
|---|---|---|
| 670308 | 1/1939 | Fed. Rep. of Germany . |
| 1465355 | 10/1969 | Fed. Rep. of Germany . |

*Primary Examiner*—Renee S. Luebke

*Attorney, Agent, or Firm*—Sherman Levy

[57] ABSTRACT

A waterproof switch includes a switch mechanism having an operation portion, a plurality of leads, each lead having an essentially circular outer periphery, connected to said switch mechanism and a waterproof housing having an external shape which substantially corresponds to that of the switch. The waterproof housing is formed of deformable material and formed into a deformable shape and includes a first portion having an external shape which substantially corresponds to that of the operation portion of the switch, a first housing member including a portion provided with a groove having a section which substantially corresponds to a semicircle of the circular outer periphery of the leads connected to a terminal of the switch, and a second housing member including a portion provided with a groove having a section which substantially corresponds to a remaining semicircle of the essentially circular outer periphery of the leads, whereby both the housing members are fixedly joined while the leads are held between the first and second housing members. The waterproof switch further includes a holding member of unique construction and arrangement which prevents the operation portion from moving by resilience of the housing.

1 Claim, 2 Drawing Sheets

WATERPROOF SWITCH

FIELD OF THE INVENTION AND RELATED ART STATEMENT

1. Industrial Field of Utilization

The present invention relates to a waterproof switch, and more particularly to a waterproof switch for use in a hair drier and the like.

2. Prior Art

Japanese Utility Model Application No. 61-167922 discloses a waterproof switch including a switch and a waterproof housing having an external shape which substantially corresponds to that of the switch, the waterproof switch, comprising a first member having a shape corresponding to an operation portion of the switch and a second member including a tube into which leads are inserted, has a tapered inner diameter and a tip whose external shape is slightly narrower than that of the lead.

OBJECT AND SUMMARY OF THE INVENTION

Problems that the Invention is to Solve

The conventional waterproof switch described above requires a step of inserting leads into the tube after the leads are connected to terminals of the switch with solder, and a step of fixedly mounting the first member to the second member.

It is a first object of the present invention to provide a waterproof switch on which one can perform a step of inserting leads and a step of fixedly joining the leads at the same time in a single operation after the leads have been connected to terminals of the switch with solder.

It is a second object of the present invention to provide a member for holding an operation portion of the waterproof switch according to the first invention to prevent the operation portion from moving in an unintended direction due to resilience of a housing.

Means for Solving the Problems

The first object is achieved by providing a waterproof switch including a switch mechanism having an operation portion a plurality of leads connected to said switch mechanism, said leads having a circular outer periphery, a waterproof housing having an external shape which substantially corresponds to that of the switch mechanism, the waterproof housing being formed of deformable material deformable in shape and comprising a portion having an external shape which substantially corresponds to that of said operation portion of the switch, a first housing member including a portion provided with a groove having a sectional shape which substantially corresponds to a semicircle of said circular outer periphery of leads connected to a terminal of the switch, and a second housing member including a portion provided with a groove having a sectional shape which substantially corresponds to a remaining semicircle of the circular outer periphery of the leads, whereby the first and second housing members are fixedly joined so that the leads are held between the first and second housing members.

The second object is achieved by a member for holding an operation portion, including a frame portion in the form of plate and two waveform resilient portions fixed in the frame portion, the resilient portion being disposed so that convex portions and concave portions of the waveform of one of the resilient portions correspond to convex portions and concave portions of the other of the resilient portions, respectively, and narrow portions are formed between a plurality of wide portions and adjacent wide portions, the rod operation portion of the switch being capable of being inserted into the wide portions, the narrow portion being narrower than the rod operation portion, the resilient portion being deformed so that the rod operation portion passes through the narrow portion.

Operation

The leads are fixedly connected to the terminals of the switch by using solder and the switch is then covered by the first and second housing members. The leads are fitted into the grooves of both the housing members, and both the housing members and the leads are fixedly joined by a heat seal or solder.

Since both the members are fixedly joined while the leads are fitted into the grooves, there is no gap in a portion of the leads. Accordingly, this prevents water from penetrating into the waterproof switch from the portion of the leads.

Effects of the Invention

A step of inserting the leads into holes can be omitted while forming the waterproof switch.

DETAILED DESCRIPTION OF THE PREFERRED EMBODIMENTS

FIGS. 1 to 5 show a preferred embodiment of a waterproof switch according to the present invention.

Leads 3*a* and 3*b* are fixedly connected to terminals 2*a* and 2*b* of a switch 1 by using solder or screws. The leads 3*a* and 3*b* are then transformed or bent so that the leads 3*a* and 3*b* are aligned in a substantially flat plane in this embodiment.

A first housing member 4 covers an operation portion 5 of the switch. Since the operation portion of the switch is moved, a first portion of the first housing member 4 corresponding to the operation portion 5 of the switch is formed of a deformable material such as, for example, vinyl chloride or urethane resin correspondingly and also formed into a deformable shape. As apparent from the sectional view of FIG. 1 and the top plan view of FIG. 2, the first portion of the first housing member in the embodiment comprises a cylindrical portion 4*a* in contact with the operation portion 5, a hollow annular portion 4*b* which surrounds the periphery of the cylindrical portion 4*a* and a loop frame portion 4*c* which surrounds the outside of the hollow annular portion 4*b*, and the shape of the first portion is deformed correspondingly when a position of the operation portion 5 is changed.

Figure 1:
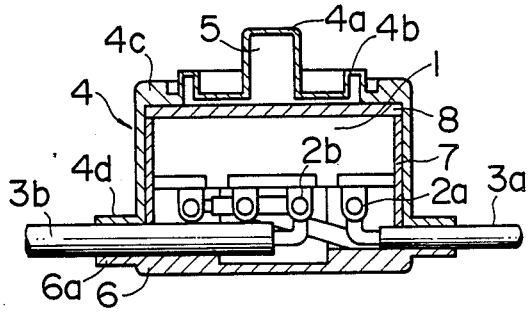
FIG. 1 is a sectional view of a preferred embodiment of a waterproof switch according to the present invention.
Figure 4:
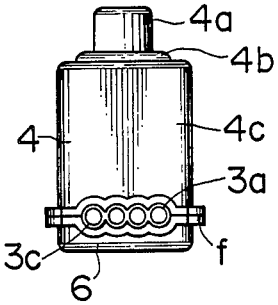
FIG. 4 is a right side view of the waterproof switch of FIG. 1.
Figure 2:
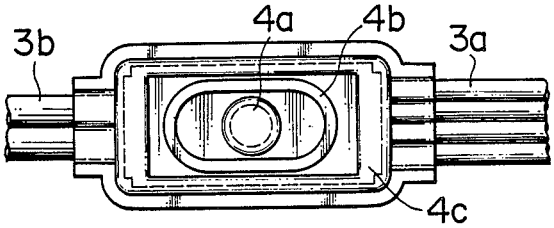
FIG. 2 is a top plan view of the waterproof switch of FIG. 1.
Figure 5:
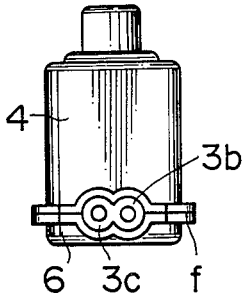
FIG. 5 is a left side view of the waterproof switch of FIG. 1.
Figure 3:
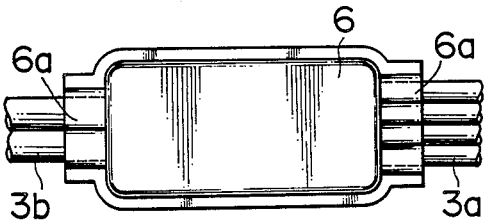
FIG. 3 is a bottom view of the waterproof switch of FIG. 1.

In the embodiment, the lead 3*a* includes a four-wire type lead in which four leads are combined in a plane and the lead 3*b* includes a two-wire type lead in which two leads are combined in a plane. Accordingly, portions 4*d* of the first housing member 4 being in contact with the leads 3*a* and 3*b* are formed correspondingly to a first half of the external shape of the four-wire type lead and the two-wire type lead, respectively, as shown in FIGS. 4 and 5.

A second housing member 6 covers the base portion of the switch. Portions 6*a* of the second housing member 6 corresponding to the leads 3*a* and 3*b* are formed correspondingly to a second half of the four-wire type lead and the two-wire type lead, respectively, as shown in FIGS. 4 and 5.

Substantially rectangular reinforcement plates 7 formed of hard synthetic resin are disposed or fixed at sides of the switch 1 and a holding member 8 of the operation portion which is formed of hard synthetic resin and formed into a resiliently deformable shape is disposed or fixed at one surface of the switch 1. The reinforcement plate 7 and the holding member 8 are covered by the first housing member 4. The second housing member 6 is disposed at the base portion of the switch 1 and both the housing members 4 and 6 are joined with heat or adhesion at the surface in which both the housing members are brought into abutment with each other.

Both the housing members 4 and 6 and the leads are fixed to each other while the leads are held between both the housing members 4 and 6 so that water does not penetrate into the waterproof switch from the portion between housing members 4 and 6 into which the leads are inserted. Both the housing members 4 and 6 are formed of resilient material, and both the housing members and the leads are fixed in position while the leads are pressed strongly between both the housing members so that the waterproof characteristic can be obtained. It is preferable in view of the waterproof characteristic that an insulating sheath 3c for the leads is formed of the same material as that of the housing members and both the housing members and the sheath of the leads are joined with heat.

Further, it is not necessary that the shape of the portion of the housing member which comes into contact with the lead is previously and strictly formed to be completely identical with the external shape of the lead, and both the housing members can be pressurized from the outside thereof to be transformed by heat so that the shape of the portion of the housing member can be formed to correspond to the external shape of the sheaths for the leads when both the housing members are joined.

Figure 6:
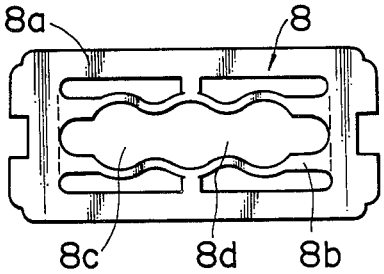
FIG. 6 is a top plan view of an operation portion holding member used in the waterproof switch of FIG. 1.
Figure 7:
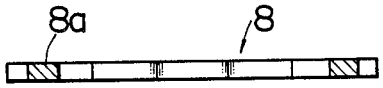
FIG. 7 is a sectional view of the operation portion holding member of FIG. 6.
Figure 8:
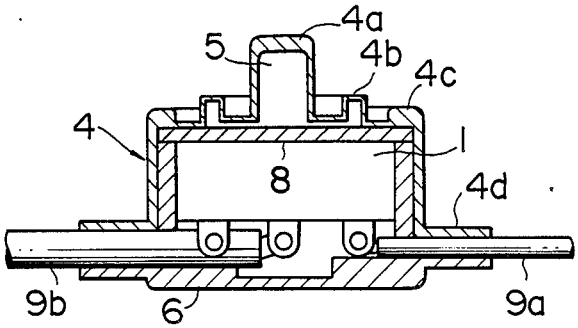
FIG. 8 is a sectional view of another preferred embodiment of a waterproof switch according to the present invention.
Figure 11:
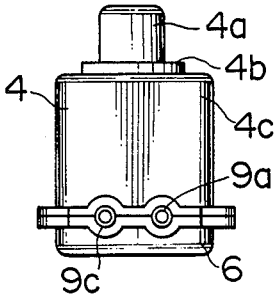
FIG. 11 is a right side view of the waterproof switch of FIG. 8.
Figure 9:
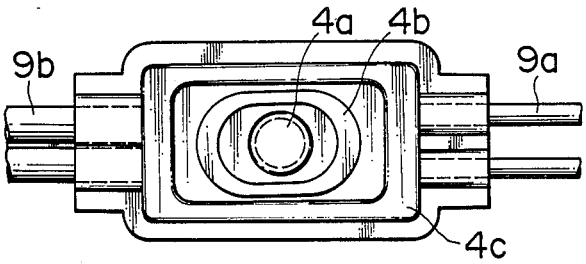
FIG. 9 is a top plan view of a waterproof switch of FIG. 8.
Figure 12:
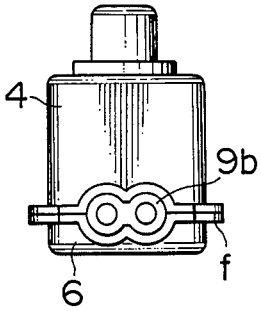
FIG. 12 is a left side view of the waterproof switch of FIG. 8.
Figure 10:
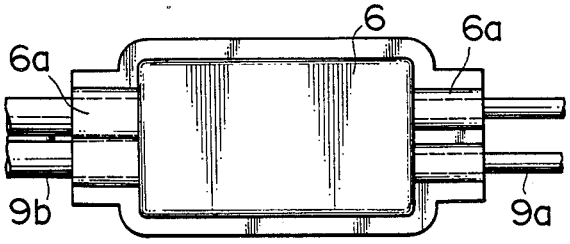
FIG. 10 is a bottom view of the waterproof switch of FIG. 8.

In order to prevent the operation portion 5 from being moved in an unexpected direction due to resilient force produced by deformation of the first portion of the first housing member 4 when the operation portion 5 is moved to operate the switch, the holding member 8 is disposed at the first portion of the switch 1. As shown in FIGS. 6 and 7, the holding member 8 includes a plate member including a substantially rectangular frame portion 8*a* and resilient waveform portions 8*b* formed in the rectangular frame portion 8*a* and having three wide portions 8*c* and two narrow portions 8*d*. The operation portion 5 is positioned in any one of the three wide portions 8*c* so that the position of the operation portion 5 is maintained stably. When the operation portion 5 is moved longitudinally from one wide portion 8*c* to another wide portion 8*c* adjacent said one wide portion, the resilient portion 8*b* deforms resiliently.

The embodiment shows an example of a selection switch which turns off a power source when the leads 3*b* are connected to a power source and the operation portion 5 is moved to, for example, a central wide portion 8*c* and which supplies an electric power to two leads of the leads 3*a* at the output side to energize circuits when the operation portion 5 is moved to a left or right wide portion 8*c*.

Figure 13:
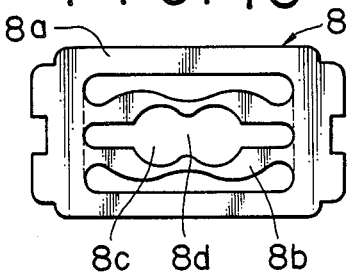
FIG. 13 is a top plan view of an operation portion holding member used in the waterproof switch of FIG. 8.
Figure 14:
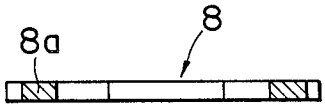
FIG. 14 is a sectional view of the operation portion holding member of FIG. 13.

FIGS. 8 to 12 show another preferred embodiment according to the present invention. The embodiment shows an example of an on-and-off switch which is provided between leads 9*a* consisting of two solid wires and a two-wire type combined lead 9*b*. This embodiment is substantially identical with the embodiment shown in FIGS. 1 to 7 except that the configuration of the lead is different. Accordingly like numerals is given to the corresponding elements and description thereof is omitted. In this embodiment, the holding member 8 of the operation portion includes two adjacent wide portions 8*c* and one narrow portion 8*d* interconnecting said adjacent wide portions 8*c* as shown in FIGS. 13 and 14.

I claim:

1. A waterproof switch including a switch mechanism having an operation portion, a plurality of leads connected to said switch mechanism, a waterproof housing having an external shape substantially corresponding to that of the switch mechanism, characterized in that said waterproof housing is composed of deformable material and comprises a first housing member and a second housing member, and each of said leads is enclosed in a sheath made of the same deformable material as said housing, said leads having essentially circular outer peripheries, said first housing member comprising a first part having an external shape substantially corresponding to that of said operation portion of said switch mechanism and a second part with grooves having a cross section substantially corresponding to a semi-circle of said essentially circular outer periphery of said leads, said second housing member having a grooved part with grooves having a cross section substantially corresponding to the rest of the semi-circle of said essentially circular outer periphery of the leads, said leads being inserted between said first and second housing members and unified in watertight relationship with heat or adhesion, and the operation portion of the switch mechanism being constructed and arranged to be handled from outside of said first part of the first housing member, a holding member, the operation portion of the switch mechanism penetrating the holding member, said holding member being disposed between said first housing member, said switch mechanism and said first housing member, said holding member including a frame portion and two deformable wave-formed portions having convex parts, concave parts and ends, said holding member being fixed to the frame portion at the ends of said deformable wave-formed portions, the latter being constructed and arranged in parallel and opposed relation to each other with their convex parts and concave parts of each said wave-formed portion facing corresponding convex parts and concave parts of said other of said wave-formed portions to form at least one pair of adjacent wide holes and a narrow path interconnecting said adjacent wide holes of said pair, said wide holes and said narrow path extending longitudinally between said wave-formed portions, the operation portion of the switch mechanism being inserted into one of said wide holes, said narrow path being narrower than said operation portion of the switch mechanism, said deformable portions deforming when said operation portion passes from one of said wide holes to said adjacent wide hole through said narrow path.

* * * * *

UNITED STATES PATENT AND TRADEMARK OFFICE

CERTIFICATE OF CORRECTION

PATENT NO. : 4,876,422

DATED : October 24, 1989

INVENTOR(S) : Nobuyoshi Kanezawa

It is certified that error appears in the above-identified patent and that said Letters Patent is hereby corrected as shown below:

On the Title Page, Item 73 the Assignee, should read: Uchiya Thermostat Co., Misato, Japan Signed and Sealed this Second Day of October, 1990

*Attest:*

HARRY F. MANBECK, JR.

*Attesting Officer*

*Commissioner of Patents and Trademarks*